US007356943B2

(12) United States Patent
Behbehani

(10) Patent No.: US 7,356,943 B2
(45) Date of Patent: Apr. 15, 2008

(54) AUTOMATIC HAIR DRYER

(76) Inventor: Sabeeh Behbehani, PO Box 2943 Safat, Kuwait 13030 (KW)

( * ) Notice: Subject to any disclaimer, the term of this patent is extended or adjusted under 35 U.S.C. 154(b) by 0 days.

(21) Appl. No.: 11/435,140

(22) Filed: May 17, 2006

(65) Prior Publication Data

US 2007/0266586 A1 Nov. 22, 2007

(51) Int. Cl.
*A45D 20/12* (2006.01)

(52) U.S. Cl. ..... 34/97

(58) Field of Classification Search ..... 34/90, 34/96, 97; 219/222; 392/384; 73/73
See application file for complete search history.

(56) References Cited

U.S. PATENT DOCUMENTS 4,766,913 A * 8/1988 Klein ..... 219/222

5,857,379 A * 1/1999 Lulofs et al. ..... 73/73

* cited by examiner

*Primary Examiner*—S. Gravini
(74) *Attorney, Agent, or Firm*—Lowe Hauptman Ham & Berner, LLP

(57) ABSTRACT

An automatic Hair dryer including a hand held body, a comb attached to the body, a 120/240 V.A.C. heating element and a fan adapted to move a mass of air across the heating element and through or across the comb and into an individual's hair. A moisture sensor is disposed between the teeth of the comb and is powered by a 12 volt D.C. power supply such as a step-down transformer. When the sensor senses moisture, the comb is passed through an individual's hair and the 120 -volt A.C. current is connected to the heating element. Then, when the moisture content of the hair is relatively low, the sensor activates a switch that turns off the power to the heating element while the power to the fan is maintained until a master switch is turned off.

3 Claims, 2 Drawing Sheets

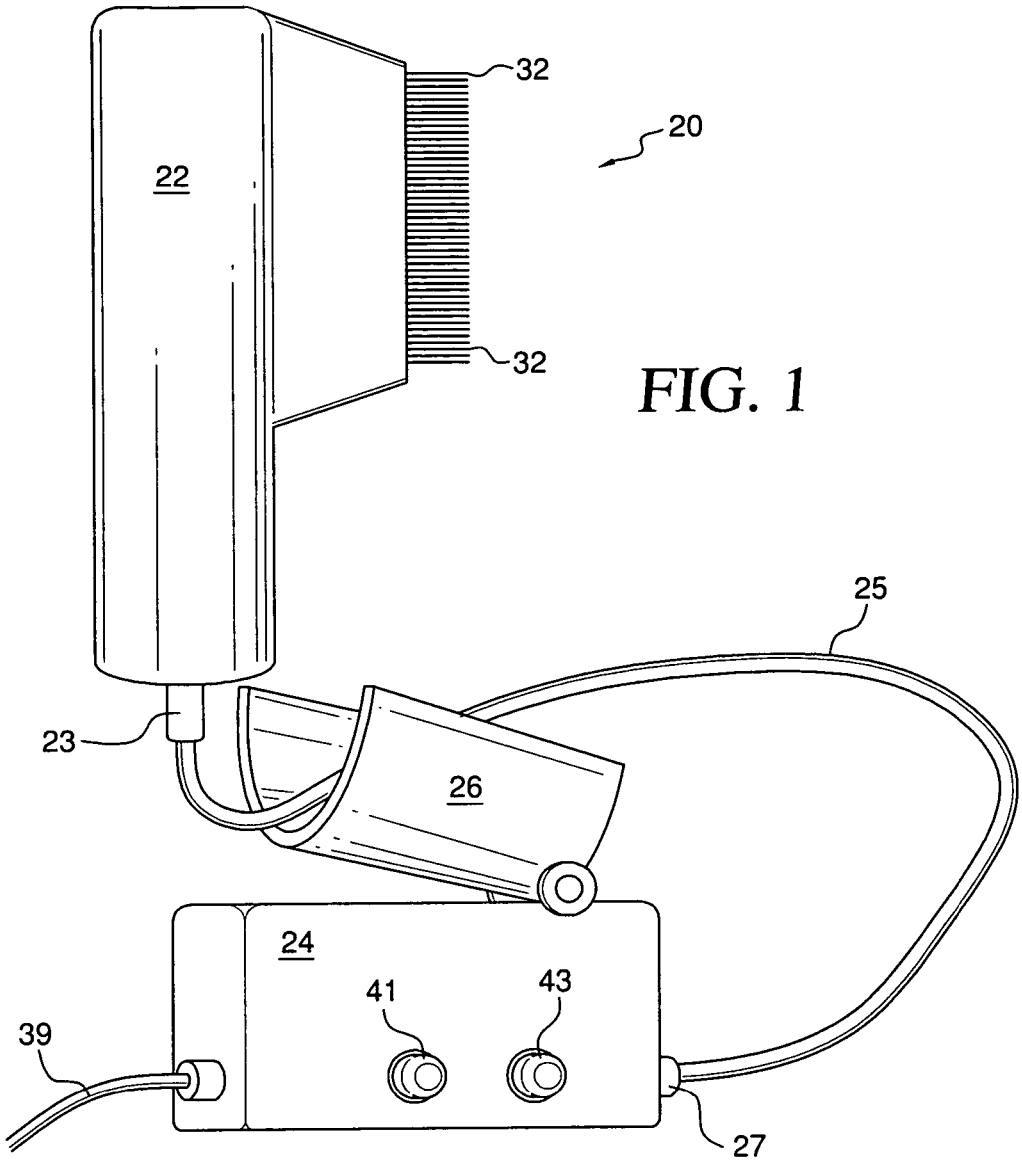
FIG. 1
FIG. 2
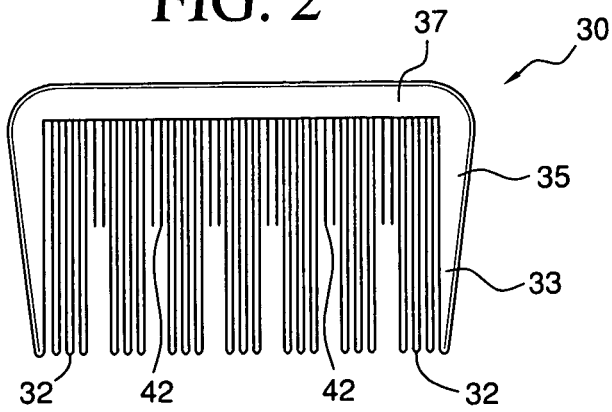

AUTOMATIC HAIR DRYER

FIELD OF THE INVENTION

This invention relates to an automatic hair dryer and more particularly to an automatic hair dryer wherein a heating element is controlled by the moisture content of an individual's hair.

BACKGROUND FOR THE INVENTION

Hair dryers are well known and broadly used by barbers, beauticians, hair stylist and by individuals in their own homes and hotel rooms. These Hair dryers are use to apply warm or more commonly hot air to dry an individual's hair. Such dryers have also been combined with a brush or comb for grooming the hair as it is being dried. The problem is that in drying the hair, there is a risk that the hair is made too dry by the hot air and may be damaged. Further, as the hair becomes dry, the roots of the hair and scalp are subjected to the hot air which may be painful and may cause minor bums and flaking of the scalp.

Therefore, it is desirable to know the moisture content of the hair and to takes steps to limit the drying effect of a dryer. For example, it is known to dispose a moisture sensor in the circulating air in a hair drying hood. However, this known method of moisture measurement is not applicable to hand held dryers.

Furthermore, Hair dryers which have electrodes arranged on an accessory which comes into contact with the hair during drying are known. In such dryers, the moisture is measured on the basis of the resistance or capacitance of the hair between the electrodes. To be more specific, a U.S. Pat. No. 4,877,042 of Downey discloses a dynamic hair grooming appliance such as a comb, a heated hair styler or a curler including a moisture sensing device and an indicator that allows the user to control the dryness of the hair during styling.

A more recent approach to controlling the moisture content of hair during styling is disclosed in a U.S. Pat. No. 6,026,821 of Last. As disclosed therein, the moistness of the hair is controlled by means of a detector which compares the amount of radiant energy in two absorption bands in the spectrum of light emitted by an infra red source and reflected by the hair. One of the absorption bands is caused by water in the hair. The amount of radiant energy in this absorption band changes significantly during the drying of the hair. The other absorption band is caused by keratin in the hair. The energy in this band changes to a much smaller extent during the drying of the hair. The intensity ratio of the two bands is an indicator for the moistness of the hair and can be employed to control the temperature and/or the air flow of the hair dryer.

Notwithstanding the above, it is presently believed that there may be a commercial market for an improved automatic Hair dryer in accordance with the present invention. There should be a market demand because such dryers reduce the likelihood of damaging a person's hair, are relatively easy to use for a professional or amateur, durable and can be sold at a reasonable price.

BRIEF SUMMARY OF THE INVENTION

In essence, the present invention contemplates an automatic Hair dryer wherein a heating element is controlled by the moisture content of the hair. For example, when the hair is dried, the heating element is turned off and yet the fan may continue to blow cool air across the hair. The automatic hair dryer includes a hand held body of a conventional type, but also includes a comb having a plurality of forwardly or outwardly extending teeth with forward and intermediate hair engaging areas or surfaces and a rear solid area that is fixed to the body. The rear solid area may be made integral with the body or fixed thereto. The Hair dryer also includes a heating element and fan disposed within the body and adapted to blow air across the heating element and into and/or through an individual's hair as it is combed. A moisture sensor of conventional design includes a probe or plurality of probes disposed between the teeth of the comb and extending from the rear area into the intermediate area of the comb. This probe or probes are short of the forward area so that they do not come into direct contact with an individual's scalp. In addition, the Hair dryer includes a source of 120/240 VAC electrical power which may be provided as 120 volts or 240 volts and may operate on either which is common in today's electronic appliances. This source of power operates the fan and heating element. An additional source of energy provides 12 volt direct current for operating the moisture sensor and removing the higher voltage from the vicinity of a person's hair. Nevertheless, a step-down transformer may be used to provide the 12 volt direct energy for energizing the sensor. Further, a Hair dryer in accordance with the present invention includes an electrical circuit means including a first power switch for turning the dryer on and off and for connecting the fan to the source of 120/240 VAC power. A second power switch connects the heating element to the source of 120/240 VAC power when the moisture sensor senses moisture as the comb is passed through an individuals wet hair. A delay circuit may also be provided to allow the heater to remain connected to the source of power while the comb is removed from the hair for brief periods of time.

The invention will not be described in connection with the accompanying drawings wherein like reference numerals have been used to indicate like elements.

DESCRIPTION OF THE DRAWINGS

FIG. 1 is a side elevational view with one part in perspective of an automatic Hair dryer in accordance with the present invention;

FIG. 2 is an elevational view of a comb including a plurality of moisture sensors as used in the present invention.

DESCRIPTION OF THE PREFERRED EMBODIMENTS OF THE INVENTION

Figure 3:
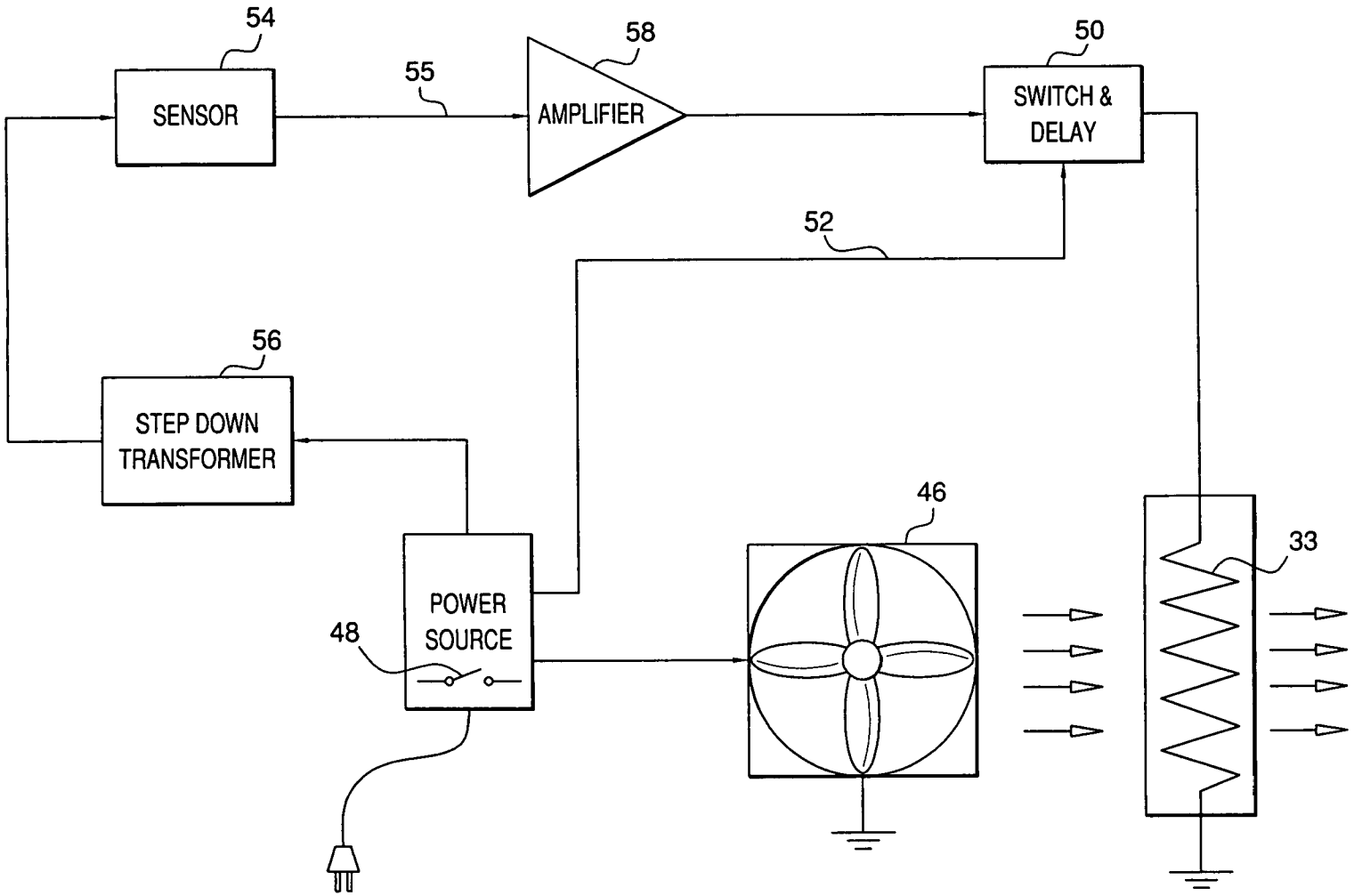
FIG. 3 is a blocked diagram of an electrical circuit as used in the present invention.

As illustrated in FIG. 1 an automatic Hair dryer 20 includes a hand held body 22 and a base 24 and holder 26 for holding the hand held body 22 when it is not in use. The hand held body 22 is connected to the base 24 by conventional electric cable or wires 25 which include a pair of grommets 23 and 27 to avoid wear at the ends of the cable 25 due to flexing as the hand held body is moved about.

A comb 30 includes a plurality of forwardly or outwardly extending teeth 32 as shown more clearly in FIG. 2. The comb's teeth include a forward area 33, an intermediate area 35 for engaging an individual's hair and a rear solid portion 37 which is maintained in place by a forward portion 40 (FIG. 1) of the body 22. As illustrated in FIG. 2, the comb 30 also includes a plurality of moisture senses 42 disposed between the teeth 32 and extending from the rear portion 37 and well into the intermediate portion 35 but short of the forward portion 33. In this way the senses do not come into contact with an individual's scalp.

As shown in FIG. 1, the base 24 includes a power cord 39 which includes a conventional plug that is plugged into an ordinary wall socket (not shown). The base 24 also includes a power indicator light 41 to indicate that the power is on and the unit is ready for use. The base 24 also includes a second indicator light 43 for indicating that a heating element is being heated.

FIG. 3 is a block diagram that illustrates an electrical circuit as used in one embodiment of the invention. As shown, the unit preferably the hand held body 24 (FIG. 1) includes an electrical heating element 33 which is typically located in a forward part of the portion 40 and a fan 46 for blowing air across the heating element 33, out of the portion 40 (FIG. 1) across the comb 30 (FIG. 1) and through an individual's hair. The fan 46 is connected to a source of electrical energy i.e. 120/240 VAC by a cord 47 and plug 49 via first power switch 48.

The heating element 33 is also connected to a power source of 120/240 V A.C. by a second power switch 50 through an electrical wire 52 to the first power switch 48 and may include a conventional delay circuit so that power is supplied to the heating element 33 during brief periods when the comb is removed from an individual's hair. The heating element is turned on when the first power switch is turned to the "on" position which activates the fan and when the source sensor 54 senses moisture in the air. The sensor 54 is provided a 12 volt DC power by a step-down transformer 56 and is connected to the first pressure switch 48 by wires 49 and 51. The step-down transformer provides 12 V D.C. power to the sensor 54. Then when the sensor 54 senses moisture in an individual's hair, it sends a signal along a connector 55 to an amplifier 58. An amplified signal is fed to the second power switch 50 which turns the second power switch to an "on" position so that the heating element 33 is energized. Therefore, the fan 46 blows air across the heating element 33 and across and into an individual's hair as the comb 30 (FIG. 1) passes through the wet hair. Then, when the sensor 54 fails to detect a predetermined amount of moisture in the hair an amplified signal turns the switch 50 to an "off" position so that relatively cool air is used in the final styling.

While the invention has been described in accordance with it's preferred embodiments, it should be recognized that changes and modifications may be made therein without departing from the scope of the appended claims.

What is claimed is:

1. An automatic Hair dryer wherein a heating element is controlled by the moisture content of the hair, said Hair dryer comprising:

a hand held body and a comb having a plurality of forwardly extending teeth with forward and intermediate hair engaging areas and a rear solid area fixed to said body;

a heating element and a fan disposed within said body and adapted to blow air across said heating element and into an individual's hair;

a moisture sensor including a plurality of probes disposed between a first plurality of said forwardly extending teeth and a second plurality of forwardly extending teeth with one of said plurality of forwardly extending teeth on each side of said plurality of probes, said probes extending from said rear area and into said intermediate area, but short of said forward area so that said probes do not come into contact with an individual's scalp;

a source of 120/240 V A.C. electrical power for energizing said fan and said heating element and a source of 12 V D.C. electrical energy for energizing said moisture sensor; and electrical circuit means including a first power switch for connecting said fan to said source of 120/240 V A.C. power when said automatic dryer is turned on and a second power switch for connecting said heating element to said source of 120/240 V A.C. power when said moisture sensor is contacted by wet hair and which includes a delay circuit so that the heating element continues to operate for short periods of time when said comb is out of contact with an individual's hair, an amplifier for amplifying a signal from said moisture sensor to thereby turn said electrical power on or off and wherein said source of 12V D.C. is energized by a step down transformer connected to said source of 120/240V A.C.

2. An automatic Hair dryer wherein a heating element is controlled by the moisture content of the hair according to claim 1 in which said source of 120/240 V.A.C. power provides about 120 volts A.C.

3. An automatic Hair dryer wherein a heating element is controlled by the moisture content of the hair according to claim 1 in which said source of 120/240 V.A.C. power provides about 240 volts A.C.

* * * * *